United States Patent [19]

Wiley

[11] Patent Number: 4,703,705

[45] Date of Patent: Nov. 3, 1987

[54] METHOD AND APPARATUS FOR WIRING A SHEET OF FABRIC

[75] Inventor: Robert T. Wiley, Asheville, N.C.

[73] Assignee: Tex-nology Systems, Inc., Arden, N.C.

[21] Appl. No.: 839,710

[22] Filed: Mar. 13, 1986

[51] Int. Cl.[4] ..... D05B 21/00

[52] U.S. Cl. ..... 112/265.1; 112/121.12; 112/119; 112/139; 112/152

[58] Field of Search ..... 112/121.12, 121.14, 112/117, 118, 119, 104, 63, 121.15, 121.27, 141, 147, 152, 2, 139, 136, 176, 178, 179; 219/212; 29/611, 729, 760

[56] References Cited

U.S. PATENT DOCUMENTS 2,490,417 12/1949 Cochran ..... 112/139 X
2,839,018 6/1958 Mulkey ..... 112/139
3,150,621 9/1964 Warnock ..... 112/147 X
3,478,422 11/1969 Inui ..... 219/212 X
4,262,613 4/1981 Landoni ..... 112/121.12

*Primary Examiner*—Peter Nerbun
*Attorney, Agent, or Firm*—Luedeka & Neely

[57] ABSTRACT

A method and apparatus are disclosed for feeding and securing a fabric tape enclosing a wire to a sheet of fabric, such as a mattress pad, along a predetermined circuitous path. The pad is supported in a generally planar configuration and is movable through a plane under the needle of a sewing head so that the needle traverses the circuitous path on the pad. The tape and enclosed wire are supplied to a guide rotatably mounted on the sewing head for guiding the tape and enclosed wire onto the pad towards the needle from locations circumferentially disposed about a vertical axis of the needle. Provision is made for moving the guide about the sewing head as the pad moves in the circuitous path under the needle so that the tape and enclosed wire move towards the needle generally along the circuitous path.

19 Claims, 20 Drawing Figures

METHOD AND APPARATUS FOR WIRING A SHEET OF FABRIC

The present invention relates generally to improvements in the art of textile manufacturing and more particularly relates to a method and apparatus for wiring a sheet of fabric, such as a mattress pad.

Methods are known for producing mattress pads incorporating heating elements in the form of insulated resistance heating wires. Ordinarily, a pattern is laid out on the pad corresponding to the path on which the electrically insulated wire is to be sewn to the fabric. A supply of suitable electrically insulated wire is introduced adjacent the sewing head of a sewing machine and the wire is usually enclosed in a confining tape. Then, an operator of the sewing machine manually aligns the tape and enclosed wire with the pattern and initiates sewing of the tape onto the pad. As the sewing proceeds, the operator holds the pad, which is usually limply draped about the sewing area, to guide the pad beneath the sewing head so that the needle of the sewing head is kept along the pattern. While doing this, the operator must also insure that the tape and enclosed wire are being introduced along the pattern in addition to monitoring other activities associated with the operation.

Manual handling of the pads in this manner limits speed of the operation, as well as introducing inconsistencies in the quality of the finished product. This requires, among other things, extensive quality control efforts which adds a significant expense to the cost of mattress pads having heating elements. The manual method is also slow and laborious.

It is accordingly an object of the present invention to provide a method and apparatus for automatically feeding and securing a tape enclosing a wire to a mattress pad fabric along a predetermined circuitous sewing path. It is another and more specific object of the present invention to provide for feeding and securing of the tape and enclosed wire along the circuitous path in such a way as to enable movement of the pad through the sewing pattern under the sewing head while keeping the needle to one side of the wire to prevent damage to the insulation of the wire.

A further object of the invention is the provision of a method and apparatus for automatically feeding and securing a tape enclosing a wire to a mattress pad along a predetermined sewing path which substantially reduces the labor which has heretofore been required to produce pads having heating elements, and which produces such pads that are of a consistent quality.

In accordance with one form of the present invention, the method of feeding and securing a tape enclosing a wire to a sheet of fabric along a predetermined sewing pattern, such as a circuitous path, includes supporting the sheet which may be a mattress pad in a generally planar configuration adjacent the needle of a sewing head. The pad is moved in a plane under the needle of a sewing head so that the needle traverses the circuitous path. The tape and enclosed wire are supplied to a position adjacent the sewing head and then fed onto the pad generally along the circuitous path ahead of the needle as the needle traverses the circuitous path so that the tape and enclosed wire are sewn to the pad generally along the circuitous path. Feeding the tape and enclosed wire preferably includes guiding the tape and enclosed wire towards the needle through a guide means configured to guide the tape and elongate wire towards the needle from locations circumferentially disposed about the needle so that the tape and enclosed wire are directed towards the needle generally along the circuitous path. In the preferred embodiment, the guide means is rotated in response to changes in direction of the pad to insure that the direction of movement of the tape and enclosed wire towards the needle causes the tape and enclosed wire to be sewn generally along the circuitous path. The method provides for substantially automatic feeding and securing of the tape and enclosed wire along the circuitous path from start to finish without the necessity of operator intervention.

In accordance with another form of the invention, the apparatus for feeding and securing a tape enclosing a wire to the pad along the predetermined circuitous path includes a support frame for supporting the pad in a generally planar configuration adjacent a sewing head having a needle to which thread is supplied for sewing the tape and enclosed elongate member to the pad. Motive structure is provided for moving the support frame and pad relative to the sewing head so that the needle traverses the circuitous path on the pad. Provision is made for supplying the tape and enclosed wire to a feed mechanism for feeding the tape and enclosed elongate member onto the pad generally along the circuitous path ahead of the needle as the needle traverses the circuitous path so that the tape and enclosed wire are sewn to the pad generally along the circuitous path. Preferably, the feed mechanism includes a guide rotatably mounted on the sewing head for rotation about the sewing head on an axis generally co-axial of a longitudinal axis of the needle. The guide is operable to guide and direct the tape and enclosed wire towards the needle from locations circumferentially disposed about the needle so that the needle is kept on the same side of the wire as it traverses the circuitous path. This eliminates the possibility of the sew path crossing the wire, and thus substantially prevents the needle from coming into contact with the wire as the tape and enclosed wire are sewn to the sheet.

These and other objects and advantages of the present invention may best be understood by reference to the following detailed description of a preferred embodiment when considered in conjunction with the accompanying drawings in which.

Figure 1:
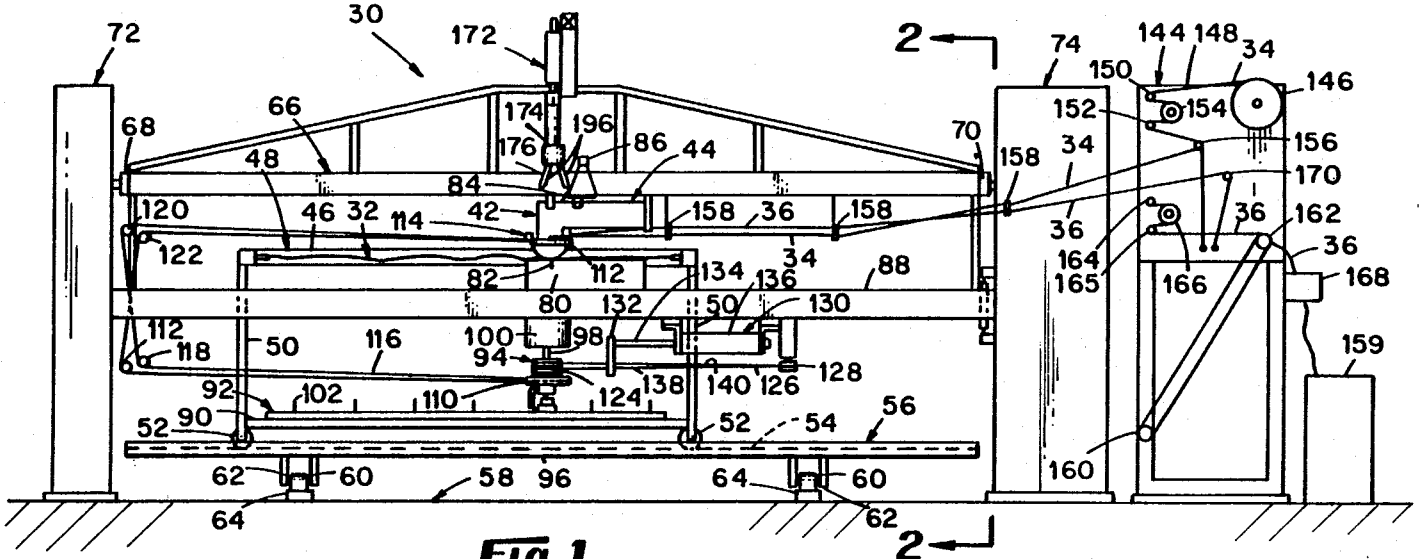
FIG. 1 is a somewhat diagrammatical, front elevational view illustrating various features of an apparatus for feeding and securing a tape enclosing a wire to a mattress pad along a predetermined circuitous path according to a preferred embodiment of the present invention.
Figure 2:
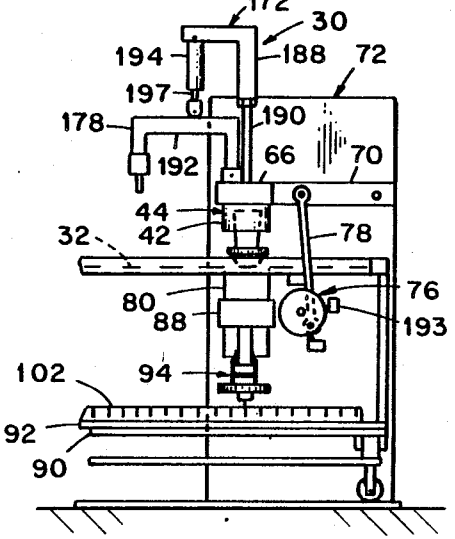
FIG. 2 is a view of the apparatus taken along line 2—2 of FIG. 1.
Figure 3:
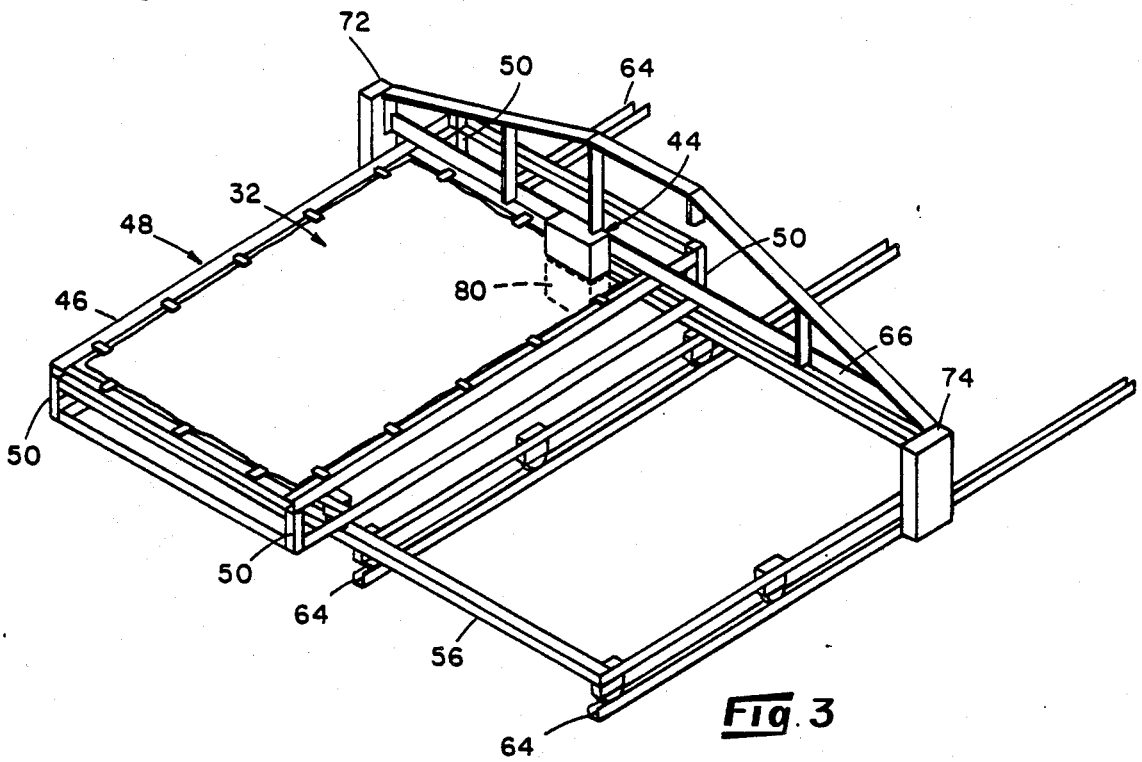
FIG. 3 is a somewhat diagrammatical, perspective view of selected features of a form of the apparatus of FIG. 1.
Figure 19:
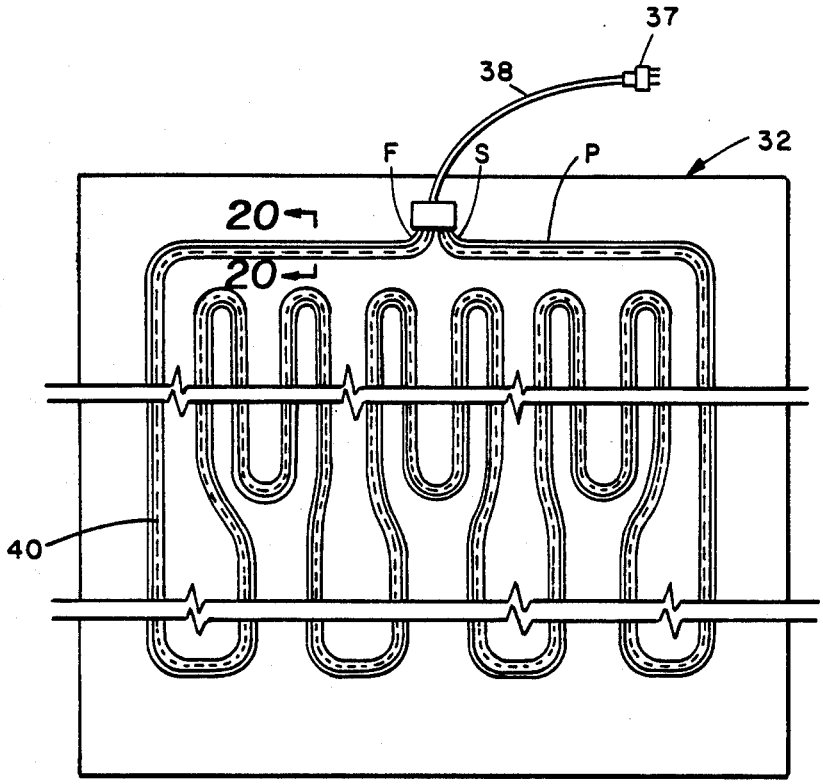
FIG. 19 is a plan view of a mattress pad incorporating a tape and enclosed heating wire secured to the pad along a circuitous path.
Figure 20:
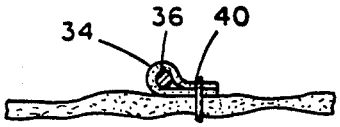
FIG. 20 is a view of the pad taken along line 20—20 of FIG. 19.

Referring now to the drawings in which like reference characters designate like or corresponding parts throughout the several views, there are shown in FIGS. 1 through 3 various features of an apparatus 30 preferably employed in practicing the method of the present invention. A description of the apparatus 30 may best be understood by initial reference to FIGURES 19 and 20 which illustrate one form of a sheet 32 to which a tape 34 and enclosed heating wire 36 has been attached along a circuitous path P on the surface of the sheet 32. The sheet 32 may be a quilted fabric intended to be secured over the upper surface of a mattress, commonly referred to as a mattress pad, and will hereinafter be referred to as a pad 32. The wire 36 is an electrically insulated heating wire which may be connected to a plug 37 through a cord 38. Once secured to the pad 32, the wire 36 is employed to provide a source of heat to the bedding arrangement by connecting the plug to a source of electrical power. As can be seen in FIG. 20, the wire 36 is enclosed lengthwise by the tape 34, the latter being arranged on the pad 32 with its opposite longitudinal edges united through provision of a stitch line 40 which is kept to one side of the wire 36 generally along the path P. Also shown in FIG. 19 is the circuitous nature of the path P and stitch line 40 from a start position S to a finish position F. Thus, it is preferable in securing the tape 34 and enclosed wire 36 to the pad 32 that the stitch line 40 be kept on the same side of the wire 36 as the tape 34 and enclosed wire 36 are applied to the surface of the mattress pad along the circuitous path P. This prevents the stitch line 40 from crossing the wire 36 which could result in damage to the electrical insulation of the wire 36.

Having thus briefly described one form of the product of the method and apparatus 30 to facilitate a better understanding thereof, reference is now had to FIGS. 1 through 3 where various features of the apparatus 30 are shown. The pad 32 is supported in a generally planar configuration below a sewing head 42 of a sewing machine 44 in an upper rectangular frame 46 of a carriage structure 48. Preferably, the sewing machine 44 is of the omni-directional, lock-stitch type.

The frame 46 of the carriage structure 48 is supported on upstanding leg members 50 of the carriage structure 48 which are in turn supported by rollers 52 at the lowermost ends thereof in longitudinal channels 54 formed in the upper surfaces of a pair of spaced-apart rails 56. Thus, the carriage structure 48 is movable to the left and right in the channels 54 of the rails 56 as viewed in FIG. 1.

The rails 56 which support the carriage structure 48 are movable in a direction substantially perpendicular to the movement of the carriage 48 and are supported above a floor 58 by means of rollers 60 that are movable in upper channels 62 of a pair of spaced-apart channel members 64 which are secured to the floor 58 generally transversally of the rails 56.

The sewing machine 44 is supported in a depending relationship above the pad 32 on a transverse beam 66 which is in turn pivotally connected by arms 68 and 70 located at opposite ends thereof to left and right-hand support housing 72 and 74, respectively. Thus, the sewing machine 44 is substantially fixed relative to the carriage 48 by virtue of its connections to the supports 72 and 74. A crank mechanism 76 mounted adjacent the inside of the support housing 74 is connected to the arm 70 by a lever 78 having its upper end pivotally located on the arm 70. Through the lever 78, the crank mechanism 76 rotates the arms 68 and 70 about their pivotal connections to the supports 72 and 74 to raise and lower the sewing machine 44 from and to its operative location above the pad 32.

A lower portion 80 of the sewing machine 44 is located beneath the head 42 and houses a bobbin (not shown) and its associated mechanisms beneath the plane of the pad 32.

The lower portion 80 of the sewing machine 44 is mounted on a lower transverse beam 88 which is connected across the width of the apparatus 30 between the supports 72 and 74 generally parallel to, and spaced below, the upper beam 66 in such a manner as to dispose the lower portion 80 in the desired vertical location relative to the sewing head 42. The lower beam 88 extends through the legs 50 of the carriage 48 which are spaced so as not to make contact with the lower beam 88 or the lower portion 80 of the sewing machine 44. The height of frame 46 above the floor 58 is selected to insure that the pad 32 is supported in the frame 46 of the carriage 48 between the sewing head 42 and the lower portion 80. The head 42 and lower portion 80 are so arranged as to provide for vertical reciprocating motion of a needle 82 of the head 42 through the pad 32 and into the lower portion 80. In a more or less conventional manner, thread 84 is supplied to the needle 82 from a spool 86 and the head 42 and lower portion 80 operate interactively to produce the stitch line 40 as the needle 82 traverses the circuitous path P.

At a rectangular base 90 of the carriage structure 48 a track support 92 is fixedly mounted generally below the frame 46, and thus below the pad 32. A track drive system assembly 94 is mounted in a depending relationship on the lower beam 88 and includes a sprocket 96 connected to the bottom end of a shaft 98. The shaft 98 is rotatably driven by a motor generally designated at 100. The motor 100 is suitably provided by a motor which operates the sewing machine with appropriate speed controls for controlling the speed of the sprocket 96 relative to the sewing speed of the sewing machine. As will be described, the sprocket 96 is operatively connected to the track support 92, one form of which is illustrated in FIG. 4, so that rotational movement of the shaft 98 is transmitted through the sprocket 96 to the carriage structure 48 and thereby provides translational motion of the pad 32 in a plane beneath the sewing head 42.

Figure 4:
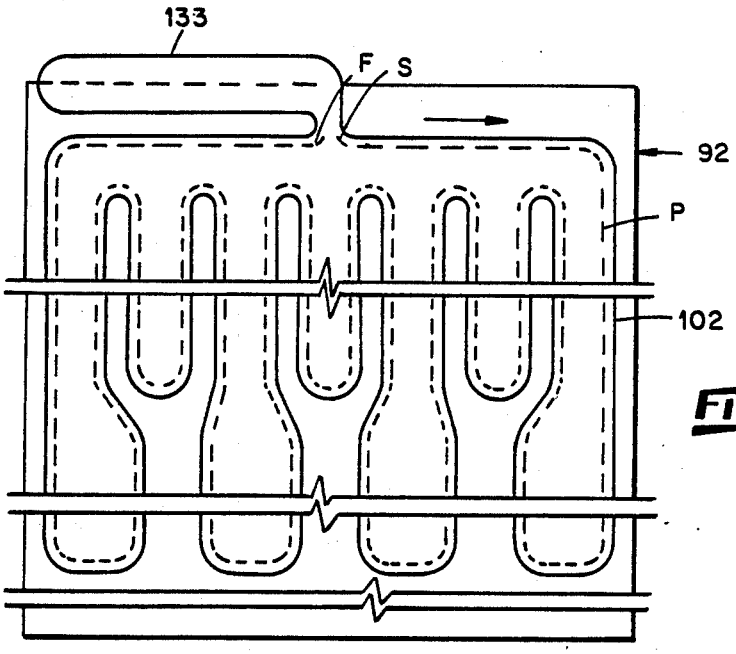
FIG. 4 is a top view of one form of a pattern track of the apparatus of FIG. 1.

As shown in FIG. 4, the track support 92 includes a raised band-like track 102 extending along the upper surface of the track support 92 which is shaped to corresond to the circuitous path P so that the track 102 contains a number of arcuate bends. The track 102 and sprocket 96 are configured so as to provide a meshing engagement therebetween so that movement of the sprocket 96 relative to the track 102 produces a corresponding movement of the carriage 48 and thus the pad 32. The direction of movement of the pad 32 is defined by the shape of the track 102 so that at any point along the track 102 the pad 32 is being directed along a line generally parallel to a line tangent to the point along the track 102. And, by virtue of the manner in which the carriage 48 is mounted above the floor 58 as described above, the movement of the pad 32 relative to the needle 82 of the sewing head 42 results in the needle 82 traversing the circuitous path P on the pad 32.

Many of the baove features of the apparatus 30, including the movable arrangement of the carriage 48 and the nature in which the sewing machine 44 is mounted are suitably provided by a Cash Model CAS-82 quilting machine manufactured by the James Cash Machine Co., Inc., of Louisville, Ky., and the sewing machine 44 may suitably be provided by a Pfaff Model No. 487 or a Singer Model No. 591 sewing machine with drop feed.

Referring again to FIGS. 1 and 2, a timing belt pulley 110 of the track drive assembly 94 is operatively connected to a guide pulley 112 of a swivel head assembly 114 rotatably mounted on the sewing head 42. The connection between the pulleys 110 and 112 is preferably accomplished through the agency of an endless timing belt 116 carried on the pulleys 110 and 112. Most preferably the timing belt 116 is provided by a positive drive belt with teeth which engage corresponding teeth on the pulleys 110 and 112. From the pulley 110, the belt 116 is carried generally horizontally to the left as viewed in FIG. 1 through the legs 50 of the carriage 48 over a pair of pulleys 117 and 118 mounted below the lower beam 88 and adjacent the left-hand support 72, and thence upwardly and over pulleys 120 and 122 mounted generally between the upper beam 66 and the lower beam 88 and adjacent the left-hand support 72. From the pulleys 120 and 122 the belt 116 is carried in a substantially horizontal direction to the right as viewed in FIG. 1 where it extends around the pulley 112 of the swivel head assembly 114. To facilitate the routing of the belt 116 as described, portions of the belt 116 which do not engage the pulleys 110 and 112 are replaced with cables if desired.

As will be described, the manner in which the timing belt pulley 110 is mounted on the track drive 94 maintains the pulley 110 in a substantially fixed orientation relative to the track 102; that is, a line passing through the approximate center of the pulley 110 and substantially perpendicular to a line tangent to the track 102 at the point along the track 102 in contact with the sprocket 96 passes through a fixed point on the circumferential edge of the pulley 110 with this geometric relation between the pulley 110 and track 102 being maintained throughout the movement of the track 102 along the circuitous path P. Also, the location of the motor 100 is determined to provide that the vertical axis of the shaft 98 is generally coaxially with the vertical axis of the needle 82 of the sewing head 42. Thus, when the track 102 and carriage 48 are made to move through rotation of the shaft 98, the timing belt pulley 110 turns relative to the sewing head 42 as the sprocket 96 encounters the arcuate portions of the track 102 with the turning motion of the pulley 110 being transmitted through the belt 116 to the guide pulley 112 on the sewing head 42. And, as will be described below, the tape 34 and wire 36 are supplied from a substantially fixed guide position to the swivel head 114 and are stored thereon, with the configuration of the swivel head 114 in combination with the interconnection of the pulleys 110 and 112 providing for feeding the tape 34 and enclosed wire 36 onto the pad 32 generally along the circuitous path P ahead of the needle 82 as the needle 82 traverses the circuitous path P so that the tape 34 and wire 36 are sewn to the pad 32 generally along the circuitous path P.

As the carriage 48 moves the pad 32 along the circuitous path P under the needle 82, the corresponding rotation of the timing belt pulley 110 is translated by a rope pulley 124 mounted atop the drive pulley 110 through a wire rope 126 to a pulley 128 of an indexing mechanism 130. The indexing mechanism 130 is preferably located to the right of the drive mechanism 94 as viewed in FIG. 1 and is secured to the undersurface of the lower beam 88 in relative alignment with the drive mechanism 94. The rope 126 is wrapped around the pulley 124 several times and is guided to and from the pulley 128 through spaced-apart openings (not shown) in a plate 132 of the indexing mechanism 130. The plate 132 is mounted on the end of a rod 134 carried in a pneumatic cylinder 136 of the indexing mechanism 130. Stops 138 and 140, which are suitably provided by adjustable nuts or knots in the rope 126, are positioned on the rope 126 at predetermined locations and are moved between the plate 132 and pulley 128 as the rope 126 is moved by the rope pulley 124. When the rope pulley 124 rotates, one of the stops 138 or 140 will be advanced towards the plate 132.

When the track 92 has been moved to the finish position F of the circuitous path P, a limit switch (not shown) is engaged to interrupt the power supply to the motor 100 stopping movement of the track 102 and carriage structure 48. At this time, as will be described, the tape 34, wire 36 and thread 84 will be cut while the sewing machine 44 is raised above the pad 32. Then, in the preferred embodiment, the motor 100 is again energized to cause the sprocket 96 to move the track 102 through a non sewing zone 133 (see FIG. 4) up to the start position S where another limit switch (not shown) stops the motor 100. During this time, the sewing machine 44 is held in a non-operative state. Through appropriate circuitry and mechanisms, the switch at the start position S is further operable to introduce a supply of air to the cylinder 130 drawing the piston 134 back into the cylinder 130. Assuming that movement of the track 102 causes movement of the stop 138 towards the plate 132, this causes the plate 132 to bear against the stop 138 pulling the stop 138 and the portion of the rope 126 to which is attached in the direction of the pulley 128 which rotates the rope pulley 124 and thus the timing belt pulley 110 in a direction opposite the direction in which the pulley 110 was rotated during the advancement of the track 92 through the circuitous path P. Movement of the rod 134 into the cylinder 136 should stop just prior to the stop 140 engaging the plate 132. In this regard, the distance through which the plate 132 moves is selected to be substantially equal to the length of the arc through which the rope pulley 124 was turned by virtue of movement of the track 92 through the circuitous path P. And since the timing belt pulley 110 is connected by the belt 116 to the guide pulley 112 of the swivel head 114, the latter is likewise rotated, with the circumferential dimensions of the pulleys 110 and 112 being substantially equal so that the swivel head 114 rotates through the same angle, approximately 360°, and thus the same distance as the drive pulley 110. This provides for repositioning of the tape 34 and enclosed wire 36 relative to the needle 82 that the tape 34 and enclosed wire 36 were in at the start position S prior to movement of the pad 32 through the circuitous path P under the needle 82.

Also shown in FIG. 1 is one manner in which the tape 34 and wire 36 may be supplied to the swivel head 114. Tape 34 and wire 36 are supplied with a constant low tension which requires take-up of tape and wire of various times in operation as will become apparent hereinafter. A tape and wire storage assembly 144 is located to the right of the right-hand support housing 74 and includes a tape roll 146 rotatably mounted near the top of a front panel 148 of the storage assembly 144. Suitable braking means are provided (not shown) at the connection of the tape roll 146 to the front panel 148 to control the rate at which the tape 34 pays off of the roll 146. The tape 34 passes over a pair of vertically aligned idler pulleys 150 and 152 rotatably mounted on stub shafts fixed to the panel 148. A drive roll 154 is mounted between the pulleys 150 and 152 for frictionally engaging the tape 34 to pull the tape 34 off of the tape roll 146 at the desired rate. From the lower idler pulley 152, the tape 34 is passed over a floating roll 156 and thence onto the swivel head 114 through a plurality of guides 158.

The wire 36 is stored adjacent the assembly 144, ordinarily in a coiled form, in a wire box 159 open at its top out of which the wire 36 may be drawn. A length of the wire 36 at least as long as the length of the circuitous path P is stored on a pair of diagonally spaced-apart capstan-type rolls 160 and 162 projecting out from the panel 148 as viewed in FIG. 1. Each of the rolls 160 and 162 includes a plurality of grooves (not shown) for guiding individual passes of wire 36 over the rolls 160 and 162 and for separating the passes of wire 36 to prevent the wire 36 from overlapping. The rolls 160 and 162 are freely movable and the wire 36 is arranged on the rolls 160 and 162 so that the innermost loop of the wire 36 on the rolls 160 and 162, that is, the loop nearest the panel 148, pays off of the top roll 162 and is carried over a pair of generally vertically aligned, spaced-apart, idler pulleys 164 and 165 which are rotatably mounted on stub shafts extending from the panel 148. Between the pulleys 164 and 165 the wire 36 passes over a drive roll 166 which is configured to frictionally engage the wire 36 to pull the same from the wire box 159 at the desired rate. From the upper pulley 164 the wire 36 is carried over a floating roll 170 and on to the swivel head 114 through the guides 158 which are configured to receive both the tape 34 and wire 36 and to keep them separated as they move in the direction of the swivel head 114. A break detector 168 may be provided intermediate the roll 162 and wire box 159 to detect breakage of the wire 36 and initiate a shut down of the operation of the apparatus 30.

A cutter 172 is mounted on the upper beam 66 generally above the sewing head 42. A cutting head 174 thereof includes a snipper 176 for being positioned generally between the point of the needle 82 and the pad 32 to cut the thread 84, tape 34 and enclosed wire 36 after the tape 34 and enclosed wire 36 have been secured to the pad 32. This is preferably done when the sewing machine 44 is moved away from its operative position of the pad 32 by the crank mechanism 76.

As can be seen in FIG. 2, the cutter 172 includes an inverted U-shaped arm 178 pivotally connected at one end to the upper surface of the beam 66 and pivotally supporting the cutting head 174 in a depending relationship at the other end. Generally above the arm 178, an inverted L-shaped member 180 is pivotally mounted on its lower end to an upstanding post 190 fixedly connected to the upper surface of the beam 66. The upper end of the member 180 is connected to a central, generally horizontal portion 192 of the arm 178 by an air cylinder 194 carrying a rod 197 pivotally connected to the center portion 192 of the arm 178. Means are provided for causing the crank 76 to raise the sewing machine 44 upwardly and away from the pad 32 when the sprocket 96 of the track drive 94 reaches the finish position F on the circuitous path P, such as a limit switch (not shown). When the sewing machine 44 is raised, there exists sufficient length of unattached wire 36, tape 34 and thread 84 to provide a tail (not shown) of each suitable for being cut and for providing a length of the wire 36 capable of being attached to the cord 38. Rotation of the crank 76 ceases upon engagement of the same with a limit switch 193 which is utilized through the agency of appropriate circuitry to admit air into the cylinder 194. This causes the cutter head 174, by virtue of the extension of the rod 197 out of the cylinder 194, to be rotated downwardly about the pivotal connection of the arm 178 to the beam 66 to a position with the thread 84, tape 34 and enclosed wire 36 generally between opposed blades 196 of the snipper 176. A mechanism (not shown) of the cutter head 174 is then employed to close the blades 196 of the snipper 176 severing the thread 84, tape 34 and enclosed wire 36. Then, the frame 46 and pad 32 with its attached tape 34 and enclosed wire 36 can be removed from the carriage 48. A number of like frames 46 may be provided and each fitted with a blank pad 32 such as through the use of clips 195 frictionally engaging the marginal edges of the pad 32, and stored adjacent the apparatus 30. Then, immediately upon removal of a frame 46 and finished pad 32 from the carriage 48, a new frame 46 and blank pad 32 can be placed on the carriage 48 and the operation begun again with the track 102 at the start position S. During such replacement, the crank 76 holds the sewing machine 44 up and away from its operative location while the cutter head 174 rotates back to its original position.

Figure 7:
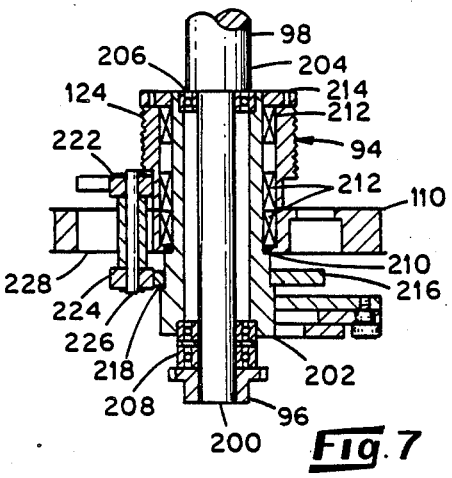
FIG. 7 is a view of the track drive assembly taken along line 7—7 of FIG. 6.

The various features of the drive mechanism 94 will now be described with reference to FIGS. 5 through 8. As can be seen in FIG. 7, the sprocket 96 is fixedly connected to the bottom end of a narrowed length 200 of the shaft 98. A sleeve 202 is generally coaxially mounted between the sprocket 96 and an upper widened portion of the shaft 204 on upper and lower bearings 206 and 208, respectively. The timing belt pulley 110 and rope pulley 124 are secured together and are rotatably mounted on a shoulder 210 of the sleeve 202 and separated therefrom by bearings 212. Upward movement of the pulleys 110 and 124 are restrained by a collar 214 secured on the upper end of the sleeve 202. A disk-shaped retainer 216 is located beneath the pulley 110 and secured to the sleeve 202 on a shoulder 218 thereof. Extending radially inwardly from the outer circumferential edge of the retainer 216 is a recess or pocket 220, viewable in FIG. 6, receiving the lower of a pair of generally vertically aligned rollers 222 and 224 rotatably mounted on a short, generally vertical shaft 226 extending though a opening 228 in the pulley 110. A lever 230 (see FIG. 6) connects the shaft 226 to the top surface of the pulley 110 by means of a round-head screw 232. The other end of the lever 230 is also connected to the top surface of the pulley 110 by means of a spring 234 connected to the pulley 110 by a round-head screw 236 generally on the opposite side thereof from the connection of the lever 230. As can be seen, the angle between the two screws 232 and 236 is approximately 120°.

Figure 5:
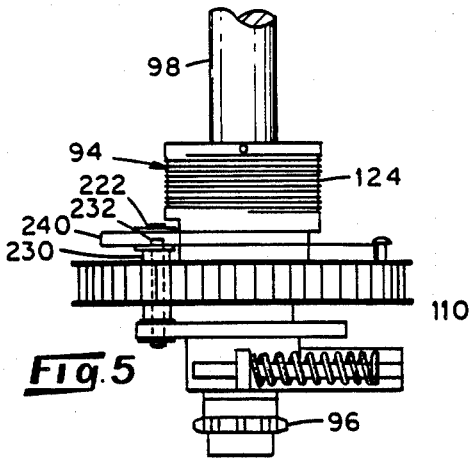
FIG. 5 is a front, elevational view of a track drive assembly of the apparatus of FIG. 1.
Figure 6:
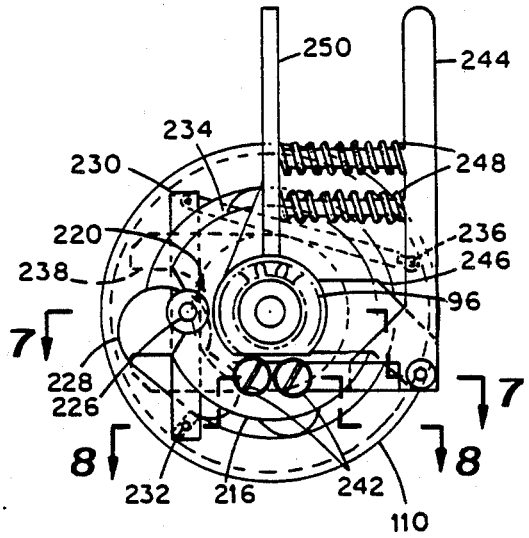
FIG. 6 is a top view of the track drive assembly of FIG. 5.
Figure 8:
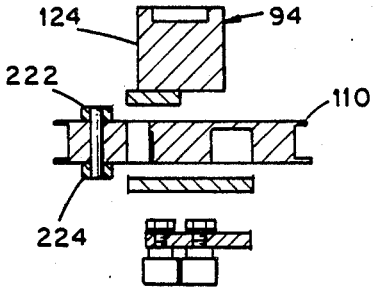
FIG. 8 is a view of the track drive assembly taken along line 8—8 of FIG. 6.

The upper roller 222 rests in a U-shaped recess 238 formed in a plate-like turning member 240 fixedly connected to, and extending from one side of, the lower end of the rope pulley 124. As seen in FIGS. 5 and 6, the turning member projects horizontally leftwardly from the approximate center of the rope pulley 124 out to a point near the circumferential edge of the pulley 110. The radially innermost edge of the recess 238 is substantially vertically aligned with the radially innermost edge of the pocket 220 in the retainer 216.

A preferred means for holding the sprocket 96 against the track 102 and in meshing engagement therewith includes a pair of closely spaced rollers 242 rotatably mounted in a downwardly depending relationship on an L-shaped grip 244. The grip 244 is pivotally connected to a support arm 246 fixedly connected to, and extending horizontally outwardly from the lower end of the sleeve 202. A pair of springs 248 are provided between the grip 244 and a handle 250 and serve to urge the grip 244 away from the handle 250. The force of the springs 248 against the grip 244 urges the grip 244 about its pivotal connection to the support arm 246 and thus maintains the rollers 242 against the sprocket 96.

Positioning of the track 102 intermediate the sprockets 96 and rollers 242 is accomplished by moving the grip 244 against the springs 248 causing the grip 244 to pivot on the support arm 246 to move the rollers 242 away from the sprocket 96. In this configuration, the sprocket 96 may be positioned in meshing engagement with the track 102 which includes a plurality of openings proportioned and spaced complimentary of the teeth of the sprocket 96. Then, the grip 244 is released and the force of the springs 248 causes the rollers 242 to press against the opposite side of the track 102 from the side of the track 102 on which the sprocket 96 is located to maintain the sprocket 96 against the track 102.

The connection between the sprocket 96 and track 102 thus establishes a driving connection between the track drive 94 and the track 102 whereby rotation of the shaft 98 induces a movement of the track 102 and carriage structure 48 with the direction of movement of the track 102 being defined by its shape. During such movement of the track 102 the sleeve 202, timing belt pulley 110, and rope pulley 124 are, by virtue of their innerconnection and the connection of the sleeve 202 to the support arm 246, maintained in a substantially constant orientation relative to the track 102 as described. Thus, movement of the track 102 through the arcuate portions of the circuitous path P produces a turning of the pulley 110 relative to the sewing head 42, whereby the connection between the pulley 110 and guide pulley 112 of the swivel head 114 by the belt 116 causes a corresponding rotation of the pulley 112 so that the swivel head 114, in a manner to be described, guides and directs the tape 34 and enclosed wire 36 in a direction which is substantially parallel to a line tangent to the circuitous path P at the location of the sprocket 96 along the track 102.

Ordinarily, movement of the track 102 through the circuitous path P, including the non-sewing zone 133, results in a rotation of the timing belt pulley 110 and rope pulley 124 of approximately 360° relative to the sewing head 42. The indexing mechanism 130 operates to reverse the rotation of the pulley 110 and rope pulley 124. When the plate 132 of the indexing mechanism 130 is made to engage one of the stops 138 and 140, rotation of the rope pulley 124 is urged by the pulling force of the wire rope 126. Initial rotation of the rope pulley 124 is resisted by engagement of the lower roller 224 with the walls of the pocket 220 in the retainer 216. However, since the turning member 240 is fixed to the rope pulley 124, the walls of the recess 238 of the turning member 240 engage the top roller 222 which lifts the lower roller 224 out of the pocket 220 so that the retainer 216 no longer resists rotation of the pulley 110 and rope pulley 124 relative to the sleeve 202. Hence, the pulley 110 and rope pulley 124 are permitted to rotate about the retainer 216 and sleeve 202 though an angle of approximately 360°. During such rotation, the force of the spring 234 maintains the lower roller 224 against the edge of the retainer 216. And, when the roller 224 approaches 360° rotation relative to the sleeve 202, it falls into the pocket 220 to maintain the pulley 110 and rope pulley 124 in a substantially fixed relationship with the sleeve 202, and thus substantially fixed orientation relative to the the track 102 during the next traversal of the track 102 through the circuitous path P.

The stroke of the cylinder 136, as limited by stops 138 and 140 on rope 126, and thus the distance through which the plate 132 moves, is selected to be substantially equal to the length of the arc through which the rope pulley 124 moves in its 360° rotation. It should be noted that the force of the spring 234 is sufficient to overcome any tendency of the lower roller 224 to be displaced from the pocket 220 during movement of the track 102 through the circuitous path P which may be caused by the frictional resistance to movement of the swivel head assembly 114 and indexing mechanism 130.

A preferred form of the swivel head 114 will now be described with reference to FIGS. 9 through 11. As can be seen in FIG. 10, the guide pulley 112 includes a centrally located sleeve 260 configured to be substantially co-axially aligned with the vertical axis of the needle 82 (omitted from FIG. 10 for clarity). shown). The sleeve 260 is fixedly connected to a downwardly facing nose 262 which is of a cylindrical configuration and is substantially closed on its lower end and open at its top, with an inner diameter substantially equal to the inner diameter of the sleeve 260. An opening 264 is provided in the approximate center of the closed end of the nose 262 and is dimensioned to be slightly greater than the diameter of the needle 82 for permitting the needle 82 to reciprocate vertically through the opening 264. Like the sleeve 260, the nose 262 is configured to be substantially co-axially aligned with the needle 82.

A shoulder 266 provided on the inner wall of the nose 262 receives a bearing 268 to which is connected an annular ring 270 which forms the lower end of a presser foot 272, the latter being considered a part of the sewing head 42. The ring 270 is substantially fixed rotationally, and by virtue of the bearing 268 the nose 262 and thus the guide pulley 112 are seen to be rotatably connected to the presser foot 272 an therefore to the sewing head 42 for rotation about an axis substantially co-axial with the axis of the needle 82. Fastened to an upper face 274 of the pulley 112 are a plurality of rollers 276 with the preferred arrangement including four rollers 276 substantially equally spaced around the circumference of the pulley 112. The rollers 276 are secured to the pulley 112 by brackets 278 extending generally radially outwardly from the pulley 112 and are rotatably mounted on the brackets 278 by means of shoulder bolts 280 so that the rollers 276 each rotate on an axis generally parallel to the axis of rotation of the pulley 112.

A former 282 including a forming portion 284 and a guiding portion 286 is secured to the outer surface of the lower closed end of the nose 262 by a bracket 288. The forming portion 284 extends generally vertically upwardly from the guiding portion 286 (hereinafter referred to as guide 286) through one of four openings 290 provided in the pulley 112.

Each of the rollers 276 includes a sheave 292 and a spool 294 located between the sheave 292 and bracket 278. As is shown, each sheave 292 has a round-bottomed groove extending around its circumference and each spool 294 has a generally flat-bottomed groove extending around its circumference. The grooves in the sheaves 292 are proportioned to support a length of the wire 36 between adjacent rollers 276 generally circumferentially about the pulley 112. Likewise, the grooves in the spool 294 are proportioned to support the tape 34 in a substantially flat, spread out configuration, between adjacent rollers 276 generally circumferentially of the pulley 112. The sheaves 292 are preferably movable relative to the spools 294 to accommodate relative differences in the speed of movement of the tape 34 and wire 36 towards the former 282.

Figure 9:
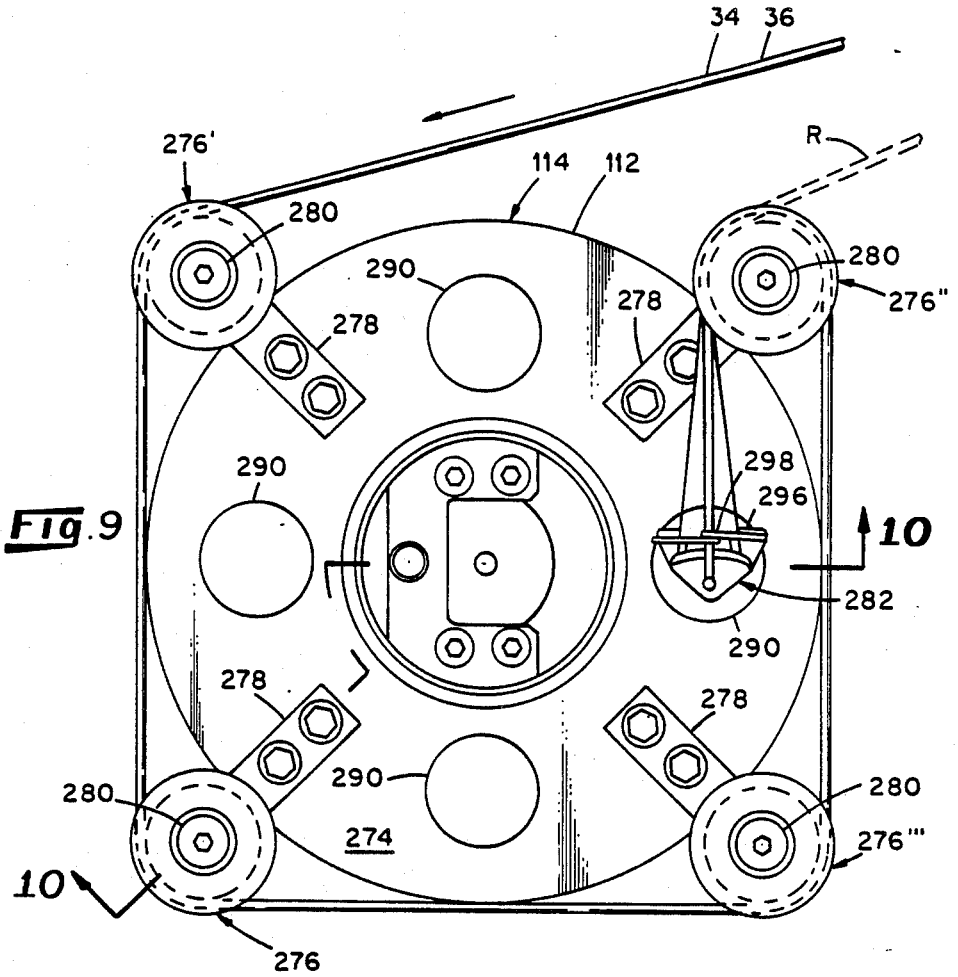
FIG. 9 is a top view of a swivel head assembly of the apparatus of FIG. 1.
Figure 10:
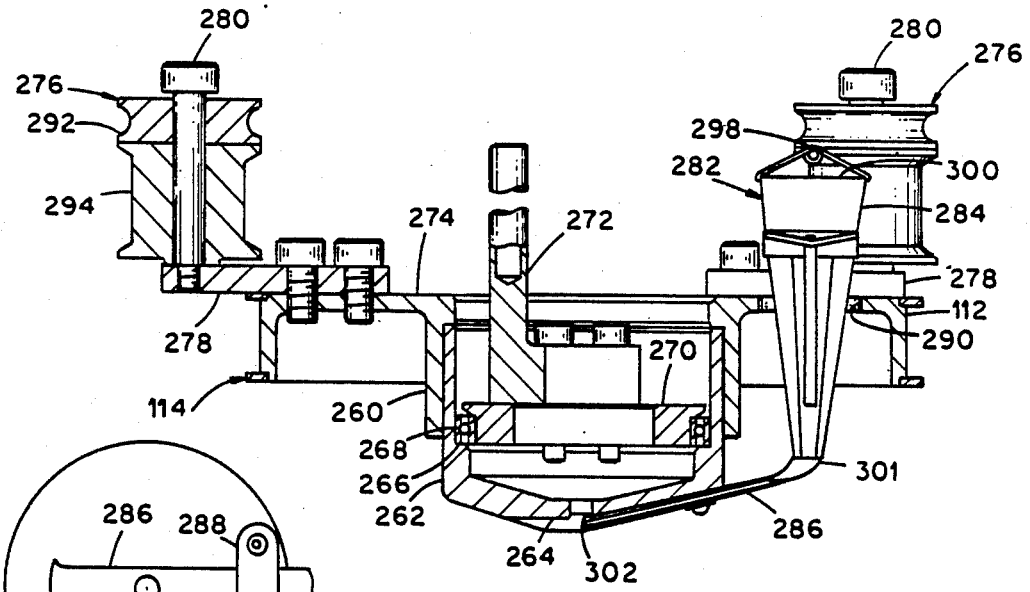
FIG. 10 is a view of the swivel head assembly taken along line 10—10 of FIG. 9.

In FIG. 9, the tape 34 and wire 36 are illustrated moving in the direction of one of the rollers 276' from one of the guides 158 mounted adjacent the sewing machine 44, the arrow being provided to indicate the direction of movement of the tape 34 and wire 36. Since the tape 34 and wire 36 are substantially vertically aligned as they move towards the roller 276' they are not independently viewable in this configuration. As can be seen, the tape 34 and wire 36 are carried on all four of the rollers 276 and pay off of the roller 276'' adjacent a back side 296 of the former 282. The wire 36, being above the tape 34, pays off of the roller 276'' towards an eye 298 of the former 282. The tape 34 pays off of the roller 276 in a generally flat, spread out configuration, and undergoes a half-twist before passing over a bridge 300 of the former 282, still in a substantially flat, spread out configuration, and is beneath the eye 298. From the bridge 300, the tape 34 is united edgewise in an enveloping fashion around the wire 36 as both pass downwardly through the forming portion 284 in the direction of the guide 286. The tape 34 and wire 36 are conducted through an elbow 301 at an angle of approximately 120° out of the forming portion 284 and into the guide 286. On reaching the guide 286, the wire 36 is substantially enclosed in the tape 34 and is issued out of an open end 302 of the guide 286 ahead of the needle 82 as the latter traverses the circuitous path P.

It should be appreciated that disposing the tape 34 and wire 36 on the rollers 276 in the manner shown provides the capability of having the tape 34 and wire 36 proceed toward the sewing head 42 from a substantially fixed position. This is accomplished by storing sufficient tape 34 and wire 36 on the rollers 276 to permit at least a 360° rotation of the swivel head assembly 114 as the latter is rotated relative to the sewing head 42 by the rotation of the timing belt pulley 110 when the track 102 is made to traverse the circuitous path P. This function can be appreciated when the swivel head 114 of FIG. 9 is imagined to rotate 360° from the orientation shown, whereupon the tape 34 and wire 36 will be seen proceeding generally along the same direction as before the 360° rotation but will be directed towards the roller 276'' generally along the dotted lines designated by the symbol R. When the track 102 reaches the finish position F and through the zone 133 as described, and the indexing mechanism 130 is activated, the swivel head 114 will be rotated counterclockwise relative to FIG. 9 to again dispose and store a length of tape 34 and wire 36 around the rollers 276 as described.

It will be appreciated by those skilled in the art that the arrangement of the tape 34 and wire 36 on the swivel head assembly 114 shown in FIG. 9 may be altered, so that the tape 34 and wire 36 feed to the former 282 from the rollers 276 in a clockwise direction from the guides 158, rather than counter-clockwise as is shown. This would be accomplished, for example, by having the tape 34 and wire 36 approach the assembly 114 from the right as shown in FIG. 9 making initial contact with the roller 276''' and then passing over the other rollers and paying off the outside of roller 276'' towards the former 282. To enable the desired forming of the tape 34 around the wire 36 in this arrangement, the forming portion 284 would be turned slightly so that the bridge 300 is approximately perpendicular to the direction in which the tape 34 and wire 36 pay off the roller 276''. Moreover, to keep the tape 34 and wire 36 paying off the roller 276'' towards the former 282 as described, it will ordinarily be necessary to dispose a length of tape 34 and wire 36 on the rollers 276 which is greater than the net decrease in stored length which will occur during movement of the track 102 through the circuitous path P. To this end, the swivel head assembly 114 would be oriented on the sewing head 42 in such a manner as to provide that the guide 286 is initially directing the tape 34 and enclosed wire 36 along the circuitous path P at the start position S thereof, with such a length of tape 34 and wire 36 being stored on the rollers 276 as will be required to ensure that when the track 102 makes a complete traversal of the path P, including the non-sewing zone 133, tape 34 and wire 36 are still directed toward the former 282 from the roller 276''. During set up, this may conveniently be achieved by rotating the swivel head assembly 114 360° after first passing the tape 34 and wire 36 over the roller 276''', around the other rollers and through the former 282 with guide 286, the 360° rotation being performed with the cable 116 disengaged from the guide pulley 112 so as to maintain the correct relationship between the timing belt pulley 110 and guide pulley 112. Of course, the same extra length of tape 34 and wire 36 may also be used in the arrangement shown in FIG. 9. And, it should be noted that the grooves in the sheaves 292 and spools 294 are approximately proportioned to support more than one wrap of tape 34 and wire 36 about the swivel head assembly 114.

Figure 11:
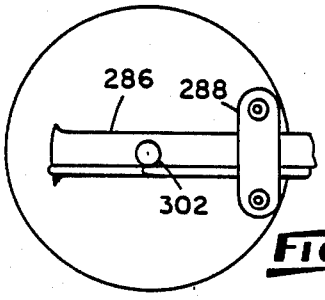
FIG. 11 is a partial bottom view of the swivel head assembly of FIG. 9 illustrating the position of a tape and enclosing wire channel guide member relative to a needle opening if the swivel head assembly.
Figure 12:
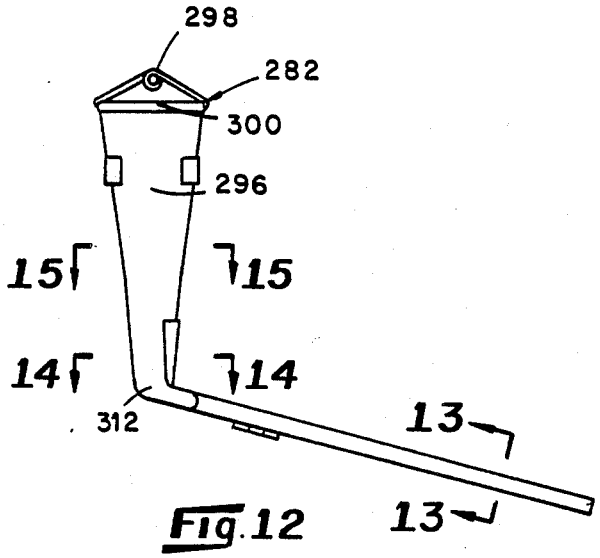
FIG. 12 is a side elevational view of a forming device for forming the tape around the wire and guiding the tape and enclosed wire to the needle.

As can be seen in FIG. 11 the issuing opening 302 of the guide 286 is positioned relative to the needle opening 264 so as to present the overlapped portions of the tape 34 in the appropriate position relative to the needle 82 so that the needle co-joins the overlapped layers of the tape 34 along the sew line 40 on one side of the wire 36, and is not permitted to cross the location of the wire 36 at any point along the circuitous path P.

Figure 16:
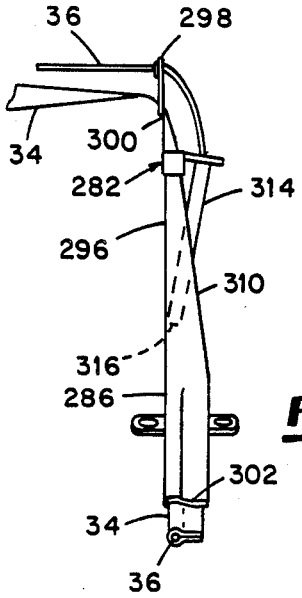
FIG. 16 is a front elevational view of the forming device of FIG. 12.

The former 282 illustrated in FIGS. 9 and 10 will now be described with reference to FIGS. 12 through 18. For the purpose of illustration, the wire 36 and tape 34 are shown in FIG. 16 moving through the forming portion 284 and issuing out of the opening 302 of the guide 286, which acts as a channel directing the movement of the tape 34 and enclosed wire 36 towards the needle 82. After passing over the bridge 300, the tape 34 moves generally downwardly along the inner surface of a progressively inwardly curled member 310 which extends generally between the bridge 300 and the elbow 301 at an entrance point 312 of the guide member 286. Comparing FIGS. 14 and 15, it is seen that the member 310 is configured near its bottom end so as to produce a fold generally along the longitudinal center of the tape 34. Meanwhile, the tape 36 is passed through the eye 298 and into a tube 314 supported on the former 282 and having a lower open end 316 oriented to pass the wire 36 issuing therefrom generally into the folded tape 34 just above the position in the member 310 illustrated in FIG. 14. This configuration provides for the wire 36 being positioned in the tape fold generlly at the deepest part of the fold so that the tape 34 and now enclosed wire 36 issue out of the guide 286 as shown in FIGURE 16.

Figure 13:
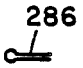
FIG. 13 is a view of the forming device taken along line 13—13 of FIG. 12.
Figure 14:
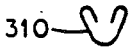
FIG. 14 is a view of the forming device taken along line 14—14 of FIG. 12.
Figure 15:
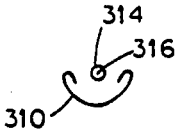
FIG. 15 is a view of the forming device taken along line 15—15 of FIG. 12.
Figure 18:
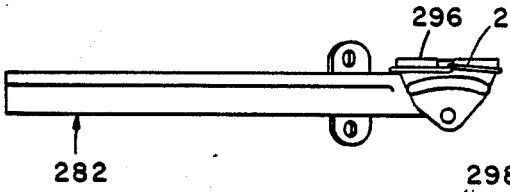
FIG. 18 is a top view of the forming device of FIG. 17.
Figure 17:
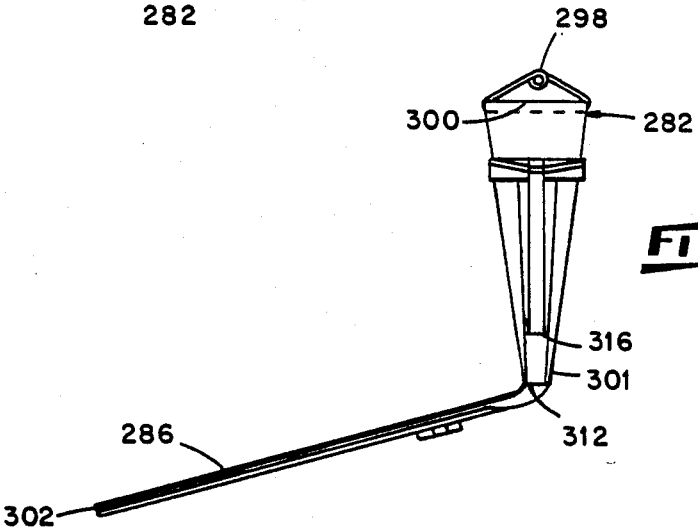
FIG. 17 is a side elevational view of the forming device of FIG. 12 on the opposite side of the forming device from that shown in FIG. 12.

As can be seen in FIGS. 13 and 16, the guide 286 is appropriately proportioned to receive the tape 34 and enclosed wire 36 while substantially restricting significant lateral movement of the same as they issue from the guide 286.

In operation, the apparatus 30 is employed to construct a pad 32 incorporating the tape 34 and enclosed wire 36 secured thereto along a circuitous path P, one form of which has previously been described with reference to FIGS. 4, 19 and 20. The tape 34 and wire 36 are presented to the swivel head 114 through provision of the guides 158 and tape and wire storage unit 144 as described above. Initially, the sewing machine may be in a raised position through employment of the crank 76. The tape 34 and wire 36 are then arranged on the swivel head 114 as described above with reference to FIGS. 9 through 11 and are threaded into and through the former 282 and made to exit the opening 302 of the guide 286 so that a small portion of the tape 34 and enclosed wire 36 hang out of the opening 302. The position of the swivel head 114 on the sewing head 42 has been previously determined so that, depending on the configuration of the track 102 used, the guide 286 will be pointed in an initial direction corresponding to the initial direction of the circuitous path P, while permitting storage of sufficient tape 34 and wire 36 on the rollers 276 of the swivel head 114 to permit the same to be rotated at least 360° as described.

Then, a frame 46 and blank pad 32 are positioned atop the carriage 48. The carriage 48 and rails 56 are then moved to position the sprocket 96 of the track drive 94 at the start position S on the circuitous path P. The thread 84 from the machine 44 is drawn from the spool 86 and conducted downwardly through the more or less conventional guides and tension controlling devices of the sewing machine 44 and through the needle 82. The crank 76 is then employed to lower the sewing machine 44 placing the sewing head 42 in its operative position above the pad 32. While doing so, the tape 34 and enclosed wire 36 are positioned under the needle 82 so that the needle 82 is above the overlapped portion of the tape 34 to one side of the enclosed wire 36. At this point the needle 82 should be substantially positioned on the desired start position S of the circuitous path P. The indexing mechanism 130 is configured with the stops 138 and 140, in substantial alignment, that is, substantially the same distance from the plate 132. Ordinarily, prior to initiating movement of the carriage 48 the tape 34 and enclosed wire 36 are pinned or otherwise temporarily fastened to the pad 32 just behind the needle 82. This may be required since it is the attachment of the tape 34 and enclosed wire 36 to the pad 32 which causes the tape 34 and wire 36 to be pulled from the tape and wire storage unit 144 through the guides 158 and swivel head 114, and without such initial attachment there may lack sufficient pulling force to cause the tape 34 and wire 36 to issue out of the guide 286.

The motor 100 is then energized through provision of an appropriate power source and circuitry (not shown) causing the shaft 98 to rotate at a desired angular velocity. At the same time, the sewing machine 44 is energized beginning vertical reciprocation of the needle 82 and associated movement of the bobbin producing the lock stitch along stitch line 40 in a conventional manner. With the sprocket 96 placed in meshing engagement with the track 102, the latter is caused to be moved by rotation of the sprocket 96 along the circuitous path P. Initial movement through the circuitous path P may ordinarily be straight line motion whereupon it is seen that the tape 34 and enclosed wire 36 are pulled out of the opening 302 of the guide 286 generally along the circuitous path P and the same is secured to the pad 32 along the stitch line 40. When the track drive 94 encounters an arcuate or curved section of the circuitous path P, the timing belt pulley 110 rotates as described above causing a corresponding of the guide pulley 112 of the swivel head 114 so that the tape 34 and enclosed wire 36 are continuously directed towards the needle 82 generally along the circuitous path P.

Viewing the circuitous path P in FIG. 19, it is seen that initial encounters of the track drive 94 with curved portions of the path P produces three right-hand or clockwise turns of the pulley 110 and 112 of the swivel head 114 with the angle through which both are turned being determined by the shape of the track 102 along the curved portions. The next bend encountered by the track drive 94 will produce a left-hand or counter-clockwise turn of the pulleys 110 and 112. As viewed in FIG. 9, this will cause a counter-clockwise rotation of the swivel head 114 advancing additional supply of tape 34 and wire 36 onto the rollers 276 at a somewhat faster rate than the rate at which the tape 34 and enclosed wire 36 are being issued out of the guide 286. As will become apparent, depending on the configuration of the track 102, reverse rotations of the swivel head 114 may cause an advancement of supplies of the tape 34 and wire 36 onto the head 114 during stages of the traversal of the track 102 through the path P that are in excess of the required for a 360° rotation of the head 114, such as when the track 102 has a spiral configuration. When the track drive 94 again encounters a straightened portion of the track 102, the rate of advancement of the tape 34 and wire 36 onto the rollers 276 slows to equal the rate of issuance of the same from the guide 286. And, during clock-wise turns the friction of the guides 158 in combination with the floating rolls 156 and 170 prevent the accumulation of slack in the tape 34 and wire 36 and take up wire 36 and tape 34 unwound off of the rollers 276 which occurs during tight turns.

As described, upon reaching the finish position F on the path P a limit switch (not shown) is activated interrupting the power supply to the motor 100 and sewing machine 44 stopping movement of the track 92 and reciprocating motion of the needle 82. This same switch may be configured to cause the crank 76 to raise the machine 44 away from the pad 32 and to cause the cutter 172 to move into position to cut the tape 34, wire 36 and thread 84 prior to movement of the track 102 through the non-sewing zone 133. Then, the frame 46 and pad 32 to which the tape 34 and enclosed wire 36 have now been secured may be removed from the carriage structure 48.

Usually, at this time, the track 102 and thus the carriage 48 are advanced through the non-sewing zone 133 after which the index mechanism 130 is employed as described. It should be noted that during movement of the track 102 through the circuitous path P, the length of tape 34 and wire 36 stored on the rollers 276 will change and, in the preferred embodiment, will be reduced to essentially zero after the track 102 is moved through the non-sewing zone 133. In this regard, a decrease in the length of tape 34 and wire 36 stored on the rollers 276 is considered to occur when the pulley 112 undergoes a positive angular displacement; that is, where the drive mechanism 94 encounters a right-hand or counter-clockwise turn in the track 102 relative to the sewing head 42, as viewed in FIG. 19. And an increase in the length of the tape 34 and wire 36 is considered to occur when the pulley 112 undergoes a negative angular displacment where the drive mechanism 94 encounters a left-hand or clockwise turn in the track 102, with the net positive angular displacment being approximately 360°. The indexing mechanism is thus operative to reverse the net positive angular displacement of the pulley 112 to restore the original length of tape 34 and wire 36 thereon that existed prior to movement of the track 102 from the start position S so that the apparatus 30 is ready for the next pad 32.

Although a particular embodiment of the method and apparatus has been described in the foregoing detailed description, it will be understood that the invention is capable of numerous rearrangements, modifications and substitutions of parts and steps without departing from the scope of the invention according to what is claimed below.

What is claimed:

1. A method of feeding and securing a tape enclosing a wire to a sheet of fabric along a predetermined circuitous path, comprising:

supporting the sheet in a generally planar configuration;

moving the sheet relative to a needle of a sewing head in a plane under the sewing head so that the needle traverses the circuitous path on the sheet; and feeding the tape and enclosed wire onto the sheet generally along the circuitous path ahead of the needle as the needle traverses the circuitous path so that the tape and enclosed wire are sewn to the sheet generally along the circuitous path.

2. The method of claim 1, wherein the feeding step includes guiding the tape and enclosed wire through a guide means towards the needle from locations circumferentially disposed about the needle so that the tape and enclosed wire are directed towards the needle generally along the circuitous path.

3. The method of claim 2, wherein the guiding step includes rotating the guide means in response to a change in direction of the sheet relative to the sewing head so that the tape and enclosed wire move through the guide means toward the needle generally along the circuitous path.

4. The method of claim 3, further comprising:

storing a length of tape and wire generally circumferentially about the sewing head on storage means;

guiding the tape and wire from a remote tape and wire supply location to the storage means;

directing the tape and wire to the guide means from the storage means;

forming the tape around the wire to provide the tape and enclosed wire as it is directed to the guide means from the storage means; and rotating the storage means as the guide means rotates so that the length of tape and wire stored on the storage means increases and decreases in proportion to the angular displacement of the guide means and storage means relative to an initial orientation of the guide means and storage means about the sewing head prior to the needle traversing the circuitous path.

5. The method of claim 4, further comprising reversing the rotation of the guide means and storage means after the needle has traversed the circuitous path through an angle approximately equal to the net positive angular displacement of the guide means and storage means that occurred as the needle traversed the circuitous path so that the length of tape and wire on the storage means is restored to the length of tape and wire that were on the storage means prior to the needle traversing the circuitous path.

6. The method of claim 1, further comprising forming the tape around the wire to provide the tape and enclosed wire for being fed onto the sheet.

7. The method of claim 6, wherein the feeding step includes guiding the tape and enclosed wire through a guide means towards the needle from locations circumferentially disposed about the needle so that the tape and enclosed wire are directed towards the needle generally along the circuitous path.

8. The method of claim 7, further comprising storing a length of the tape and wire generally circumferentially about the sewing head.

9. An apparatus for feeding and securing a tape enclosing a wire to a sheet of fabric along a predetermined circuitous path, comprising:

support means for supporting the sheet in a generally planar configuration;

a sewing head having a needle to which thread is supplied for sewing the tape and enclosed wire to the sheet;

motive means for moving said support means and sheet relative to said sewing head so that said needle traverses the circuitous path on the sheet;

feed means for feeding the tape and enclosed wire onto the sheet generally along the circuitous path ahead of said needle as said needle traverses the circuitous path so that the tape and enclosed wire are sewn to the sheet generally along the circuitous path; and supply means for supplying the tape and enclosed wire to said feed means.

10. The apparatus of claim 9, wherein said feed means comprises guide means rotatably mounted on said sewing head for rotation about said sewing head on an axis generally co-axial of a vertical axis of said needle, said guide means operable to guide and direct the tape and enclosed wire towards said needle from locations circumferentially disposed about said needle so that said needle is kept on the same side of the wire as said needle traverses the circuitous path.

11. The apparatus of claim 10, further comprising:

said supply means including means for storing a length of tape and wire generally circumferentially about said sewing head, said storage means being connected to said guide means so that said storage means rotates with said guide means and being configured to receive the tape and wire from a remote tape and wire storage location;

said length of tape and wire on said storage means being increased and decreased when said guide means and storage means rotate relative to said sewing head, the amount of increase and decrease being proportionate to the angular displacement of said guide means and storage means caused by their rotation relative to an initial orientation of said guide means and storage means about said sewing head prior to said needle traversing the circuitous path; and means for reversing the rotation of said guide means and storage means after said needle has traversed the circuitous path through an angle approximately equal to the net positive angular displacement of said guide means and storage means that occurred as said needle traversed the circuitous path so that the length of tape and wire on said storage means is restored to the length of tape and wire that was on the storage means prior to the needle traversing the circuitous path.

12. The apparatus of claim 9, wherein said feed means comprises:

guide means movably mounted adjacent said sewing head for guiding the tape and enclosed wire onto the sheet towards said needle from locations circumferentially disposed about a vertical axis of said needle; and means for moving said guide means between said circumferential locations as said motive means moves said suport means and sheet relative to said sewing head so that, at any point along the circuitous path, said guide means guides the tape and enclosed wire towards said needle generally along the circuitous path from one of said circumferential locations.

13. The apparatus of claim 9, wherein said motive means comprises rotating drive means operatively connected to a movable track, said track being shaped to correspond to the circuitous path and being attached to said support means, whereby rotation of said drive means causes said track to move said support emans and sheet along the circuitous path permitting said needle to traverse the circuitous path on the sheet.

14. The apparatus of claim 13, further comprising:

said feed means including guide means rotatably mounted on said sewing head for rotation about a vertical axis of said needle for guiding and directing the tape and wire towards said needle from locations circumferentially disposed about the vertical axis of said needle;

said drive means including a timing member connected to said guide means and means for maintaining a substantially constant orientation of said timing member relative to said track so that said timing member rotates relative to said sewing head as said track and support means move said sheet though the circuitous path, the connection between said timing member and said guide means being configured so that rotation of said timing member is translated to said guide means, whereby at any point along said circuitous path said guide means guides and directs the tape and enclosed wire towards said needle substantially along a line which is substantially parallel to a line tangent to the circuitous path at the point.

15. The apparatus of claim 14, further comprising:

said drive means including a rotating shaft having a gear and said track being configured to meshingly receive said gear, and means for holding said gear against said track;

said timing means comprising a timing pulley having its center substantially aligned with the axis of said shaft and said means for maintaining being configured to maintain said turning pulley in a substantially fixed orientation relative to said track, so that, at any location of said gear along said track a line passing through the center of said timing pulley is substantially perpendicular to a line tangent to said track at the location and passes through a fixed point on said timing pulley;

said guide means including a guide pulley rotatably mounted on said sewing head for rotation about a vertical axis of said sewing head; and an endless belt engagingly received, and connected between, said timing and guide pulleys for translating rotation of said timing pulley to said guide pulley so that rotation of said timing pulley relative to said sewing head as said track moves along said circuitous path causes a corresponding rotation of said guide pulley to orient said guide means in a position relative to said needle whereby the tape and enclosed wire move towards said needle along said circuitous path.

16. The apparatus of claim 9, further comprising:

said feed means including guide means for guiding and directing the tape and enclosed wire towards said needle, said guide means being rotatably mounted on said sewing head for rotation about a vertical axis of said sewing head, and means for moving said guide means about said sewing head as said motive means moves said support means and sheet relative to said sewing head so that said guide means guides and directs the tape and enclosed wire towards said needle along the circuitous path; and said supply means being fixedly connected to said guide means and including forming means mounted adjacent said guide means for receiving the tape and wire from a remote source of the tape and wire and forming the tape around the wire to enclose the wire as the tape and wire move towards said guide means from the remote source.

17. The apparatus of claim 16, wherein said supply means further comprises storage means for separately storing a length of the tape and a length of the wire generally circumferentially about said sewing head with said forming means being positioned relative to said storage means to formingly receive the tape and wire from said storage means and to direct the tape and enclosed wire to said guide means from said storage means.

18. The apparatus of claim 17, wherein said storage means comprises a plurality of spaced-apart rollers disposed circumferentially about said sewing head, each of said rollers having separate tape and elongate member grooves proportioned to separately receive and support the length of tape and wire respectively, about the sewing head outside of said rollers and being rotatably mounted on said supply means with the axes of rotation of said rollers being generally co-axial with the axis of rotation of said guide means, said pluarlity of rollers being configured to provide that the tape and wire pay off of one of said rollers radially inwardly of said plurality of rollers towards said forming means.

19. The apparatus of claim 18, wherein said forming means is positioned generally intermediate said one of said plurality of rollers from which the tape and wire pay off and an adjacent roller, and includes means for longitudinally folding the tape around the wire to enclose the wire as the tape and wire pay off of said one roller, and said guide means includes an elongate channel member proportioned to confiningly receive the tape and enclosed wire from said means for longitudinally folding, said channel member having a longitudinal axis extending radially inwardly of said plurality of rollers generally towards said needle and having an open exit end adjacent said needle so that movement of the tape and enclosed wire out of the open exit end of said channel member from said means for longitudinally folding is generally in the direction of said needle.

* * * * *